US007861865B2

(12) United States Patent
Green

(10) Patent No.: US 7,861,865 B2
(45) Date of Patent: Jan. 4, 2011

(54) PACKAGING ASSEMBLY

(75) Inventor: Jeffrie Green, Beverly Hills, CA (US)

(73) Assignee: Timely Inventions, LLC, Los Angeles, CA (US)

( * ) Notice: Subject to any disclaimer, the term of this patent is extended or adjusted under 35 U.S.C. 154(b) by 0 days.

(21) Appl. No.: 12/336,345

(22) Filed: Dec. 16, 2008

(65) Prior Publication Data

US 2010/0147738 A1 Jun. 17, 2010

(51) Int. Cl.
*B65D 19/00* (2006.01)

(52) U.S. Cl. ..... 206/600; 206/45.28; 206/386; 248/174

(58) Field of Classification Search ..... 206/600, 206/731, 45.28, 45.29, 38, 836, 497, 730, 206/735, 736; 248/174; 108/56.1, 56.3
See application file for complete search history.

(56) References Cited

U.S. PATENT DOCUMENTS

| | | | | | |
|---|---|---|---|---|---|
| 1,649,211 | A | * | 11/1927 | Bitzer | 206/766 |
| 2,964,169 | A | * | 12/1960 | Brachman | 206/766 |
| 3,990,601 | A | | 11/1976 | Joyce | |
| 3,993,191 | A | | 11/1976 | Membrino | |
| 4,000,811 | A | | 1/1977 | Hardison et al. | |
| 4,793,490 | A | | 12/1988 | Evert | |
| 4,809,847 | A | | 3/1989 | Schneider | |
| 4,877,137 | A | | 10/1989 | Govang et al. | |
| 4,919,270 | A | | 4/1990 | Govang et al. | |
| 4,949,898 | A | | 8/1990 | Nederveld | |
| 5,035,323 | A | * | 7/1991 | Daniels et al. | 206/386 |
| 5,251,753 | A | * | 10/1993 | Pigott et al. | 206/766 |
| 5,350,066 | A | * | 9/1994 | Mendoza et al. | 206/386 |
| 5,370,233 | A | | 12/1994 | Schutz et al. | |
| 5,704,488 | A | | 1/1998 | Smith | |
| 5,896,995 | A | * | 4/1999 | Murray et al. | 206/736 |
| 5,960,720 | A | | 10/1999 | Borland et al. | |
| 5,979,662 | A | | 11/1999 | Green | |
| 6,050,410 | A | * | 4/2000 | Quirion | 206/386 |
| 6,050,420 | A | | 4/2000 | Green | |
| 6,145,794 | A | | 11/2000 | Smith | |
| 6,152,305 | A | | 11/2000 | Green | |
| 6,267,255 | B1 | * | 7/2001 | Brush | 211/59.4 |
| 6,513,888 | B1 | | 2/2003 | Lucht | |
| 6,612,441 | B2 | * | 9/2003 | Lang et al. | 206/600 |
| 2005/0023168 | A1 | | 2/2005 | Marnocha | |
| 2007/0023319 | A1 | | 2/2007 | Honkawa et al. | |
| 2007/0227936 | A1 | * | 10/2007 | Youell | 206/600 |

* cited by examiner

*Primary Examiner*—David T Fidei
(74) *Attorney, Agent, or Firm*—Sheppard, Mullin, Richter & Hampton LLP

(57) ABSTRACT

The present invention is embodied in a packaging assembly for both economical and safe shipping, display and advertising of a plurality of products, comprising a plurality of products stacked upon a pallet and a plurality of side panels affixed to the pallet. Each side panel can be folded into an upper position in order to enclose the plurality of products during shipment of the packaging assembly and each side panel can also be folded into a lower position in order to hide the pallet and to advertise the plurality of products during display of the packaging assembly.

19 Claims, 3 Drawing Sheets

PACKAGING ASSEMBLY

BACKGROUND OF THE INVENTION

1. Field of the Invention

This invention relates generally to bulk packaging configured for both shipping and display, and more particularly, to a packaging assembly, and a related method, for economically and safely shipping and displaying a plurality of products.

2. Description of the Prior Art

It is important to both manufacturers and retailers of consumer products that such products be shipped and displayed in an efficient and economical manner. The cost of shipping products and displaying products is often calculated in the overall cost of the products, such that any savings in the overall cost is advantageous to the manufacturer and retailer and then ultimately passed on to the end consumer.

It is known to ship and display products in bulk. Typically, stacks of product containers, each containing a plurality of products, are shipped and displayed upon a pallet. For example, U.S. Pat. No. 6,152,305 to Green discloses a packaging assembly and a method of packaging a plurality of products, for economically and safely shipping and displaying a plurality of products. The packaging assembly includes a plurality of product containers, specifically display stands, contiguously arranged on a pallet, each display stand holding a plurality of products. The packaging assembly can be surrounded by panels of cardboard or other material on the sides and on the top and then wrapped in a suitable shrinkwrap material for shipping. Once the packaging assembly arrives at the retail location, the panels and shrinkwrap material are removed and the packaging assembly is ready for display and sale, without the need for unloading it from the pallet or removing the products from the display stands.

It is also known to provide side panels for a pallet in a packaging assembly. Two known reasons for side panels are to hide the pallet from view and thus increase the aesthetic appearance of the packaging assembly, and to lend structural support to a packaging assembly during shipping. By way of example, the following patents and published patent application disclose various types of side panels for a pallet in a packaging assembly: U.S. Pat. No. 4,877,137 to Govang et al., U.S. Pat. No. 5,704,488 to Smith, U.S. Pat. No. 5,896,995 to Murray and U.S. Patent Application No. 2007/0023319 to Honkawa et al.

One disadvantage of conventional side panels is that the side panels are an extra component of the packaging assembly and thus impose additional weight and cost to the packaging assembly during shipping of the packaging assemblies. Another disadvantage of conventional side panels is that once the packaging assemblies arrive at the retail location, the side panels generally serve no useful function other than to merely hide the pallet from view.

Accordingly, there has existed a definite need for an improved packaging assembly for both economical and safe shipping and display of a plurality of products, and for a related method of shipping and displaying a plurality of products that overcomes these disadvantages. The present invention satisfies these and other needs, and provides further related advantages.

SUMMARY OF THE INVENTION

The present invention is embodied in a packaging assembly for shipping and displaying a plurality of products. The packaging assembly provides for economy and efficiency by protecting the products from shipping damage and providing for fast and efficient display and advertising.

The packaging assembly comprises a pallet, a plurality of product containers, each holding at least one product, contiguously arranged on the pallet and a plurality of side panels, each including a mounting flap and a main flap. Each of the plurality of main flaps is foldable upwardly to cover one side of the plurality of product containers during shipment of the packaging assembly, and is also foldable downwardly to cover the pallet and expose the plurality of product containers during display of the packaging assembly. The main flaps have a first face and a second face, with the first face bearing printed matter. The first face is visible when the main flap is folded downwardly to advertise the products during display of the packaging assembly. Thus, the side panels advantageously minimize waste and promote efficiency because they function as a shipping cover for the products and later as display advertising for the products as well as an aesthetic cover for the pallet.

In other, more detailed features of the invention, the plurality of side panels include a first pair of opposing side panels and a second pair of opposing side panels. The main flaps of the first pair of opposing side panels include tabs projecting from each side edge of the main flap. Each tab projects substantially along the entire length of each side edge. The tabs can be positioned at a 90° angle toward the first face of the main flap or toward the second face of the main flap. The main flaps of the second pair of opposing side panels overlaps the tabs and then the main flaps are secured to one another by tape or some other suitable securing material. The tabs advantageously provide structural reinforcement to the packaging assembly by enabling the side panels to be secured to one another and to prevent a gap from occurring between the side panels when they are either folded upwardly or downwardly.

The side panels are of unitary construction and constructed of fairly rigid material such as corrugated cardboard. Each mounting flap of the side panels is generally trapezoidal in shape and each main flap of the side panels is generally rectangular in shape.

The plurality of product containers are contiguously arranged on the pallet to fit within the cavity defined by the upwardly folded main flaps. The cavity defined by the upwardly folded main flaps is generally box-shaped.

In yet other more detailed features of the invention, the packaging assembly can further include a lid that receives a portion of the side panels within the lid and covers the plurality of product containers during shipment of the packaging assembly. A suitable wrapping material can enclose the packaging assembly for protection during shipment.

The packaging assembly further includes a plurality of supporting pallets upon which the packaging assembly rests during display of the packaging assembly, which provide sufficient height in order for the main flaps to fold downwardly without touching the ground. In a preferred embodiment, the bottom-most supporting pallet is not hidden by the main flaps in order for the tines of a forklift to engage the bottom-most supporting pallet and thus move to the packaging assembly to a different location.

Other features and advantages of the invention will become apparent from the following detailed description of the preferred embodiments, taken in conjunction with the accompanying drawings, which illustrate, by way of example, the principles of the invention.

DETAILED DESCRIPTION OF THE PREFERRED EMBODIMENTS

Figure 1:
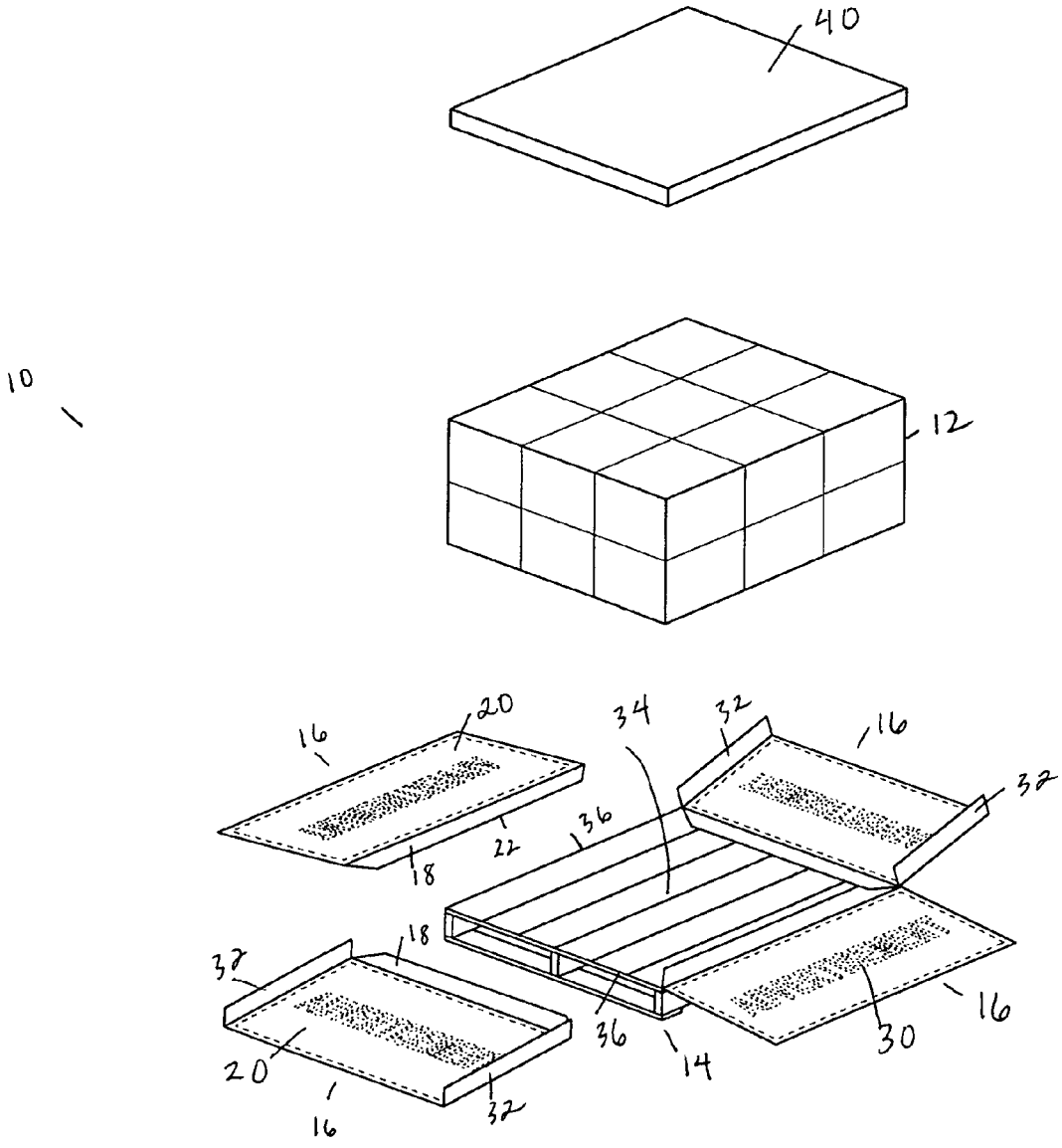
FIG. 1 is a partially exploded isometric view of a packaging assembly, in accordance with the present invention.

Referring now to the drawings, and particularly to FIG. 1, there is shown a packaging assembly 10 that includes a plurality of product containers 12 each holding at least one product (not shown), a pallet 14 on which the plurality of product containers are contiguously arranged and a plurality of side panels 16 attached to the pallet and interposed between the pallet and the plurality of product containers.

Figure 2:
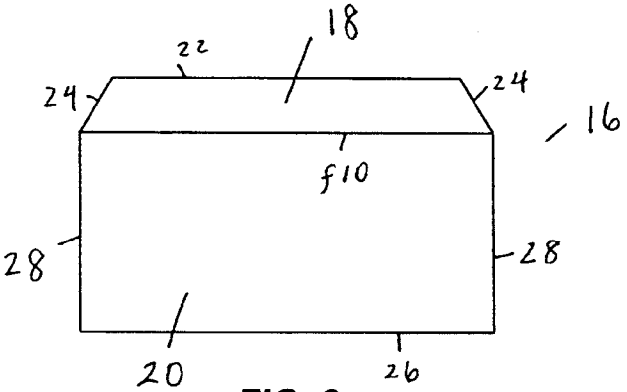
FIG. 2 is a front elevational view of a side panel included in the packaging assembly depicted in FIG. 1.
Figure 3:
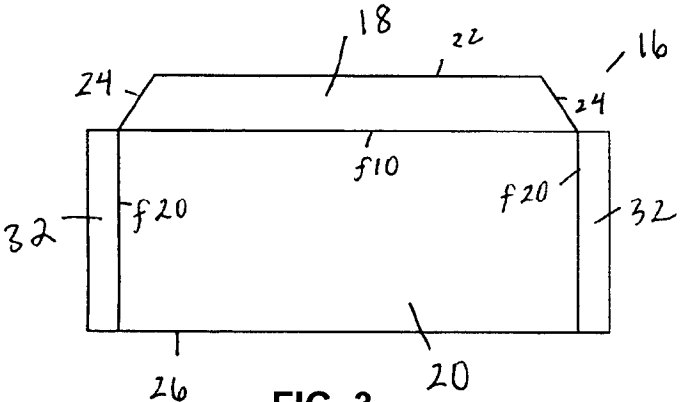
FIG. 3 is a front elevational view of a side panel with tabs included in the packaging assembly depicted in FIG. 1.

As shown in FIGS. 1-3, each side panel 16 includes a mounting flap 18 that is secured to the pallet 14 and a main flap 20 that can be folded into an upper position or a lower position. In the upper position (FIG. 4), the main flap covers the plurality of product containers 12 during shipment of the packaging assembly 10. In the lower position (FIGS. 6-7), the main flap hides the pallet. The main flap can bear printed matter to advertise the products during display of the packaging assembly. The side panels 16 advantageously minimize waste and promote efficiency because they function as a shipping cover for the products and later as display advertising for the products as well as an aesthetic cover for the pallet 14.

Each side panel 16 is of a fairly rigid sheet material, such as corrugated cardboard, of unitary construction. As shown in FIG. 2, the mounting flap 18 is generally trapezoidal in shape and has a top edge 22, side edges 24 and a fold line f10. The top edge is of a shorter length than the fold line f10. The main flap 20 is generally rectangular in shape and has a bottom edge 26 and side edges 28. The mounting flap and the main flap share the fold line f10, which defines the boundary between the mounting flap and the main flap. The main flap is bendable at the fold line f10, enabling the main flap to bend at least 180° relative to the mounting flap, namely 90° in one direction and 90° in the other direction.

Figure 7:
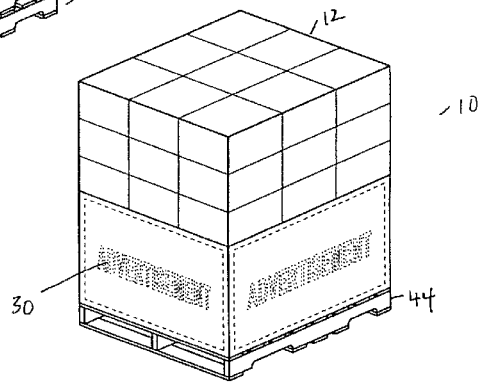
FIG. 7 is an isometric view of the packaging assembly depicted in FIG. 1, in the display configuration.

Each main flap 20 has a first face, which is exposed when the main flap is in the lower position (FIG. 4) and a second face, which exposed when the main flap is in the upper position (FIG. 7). The first face of the main flap bears printed matter 30, such as advertising.

Figure 5:
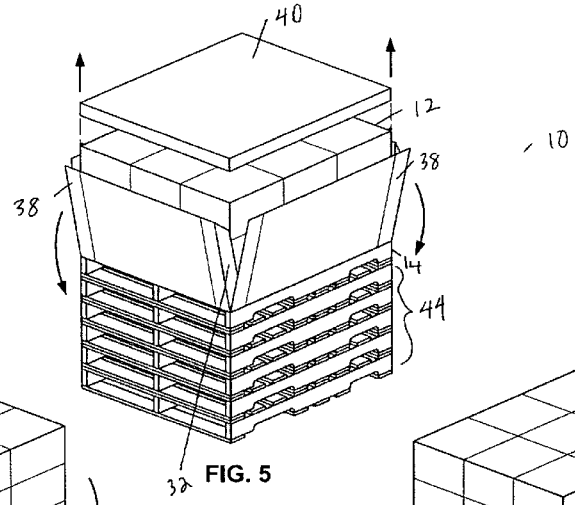
FIG. 5 is an isometric view of the packaging assembly depicted in FIG. 1, with the lid being removed and the side panels being folded downwardly for the display configuration.
Figure 6:
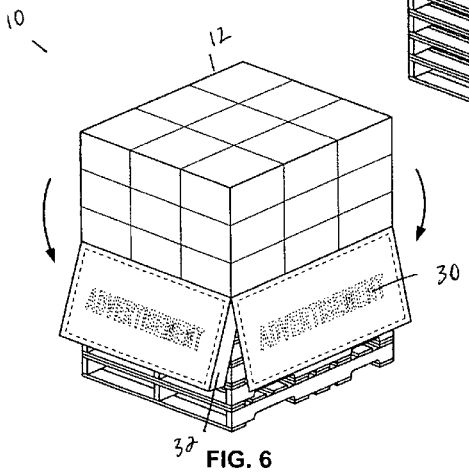
FIG. 6 is an isometric view of the packaging assembly depicted in FIG. 1, with the side panels further folded downwardly from the product containers, for the display configuration.

As shown in FIG. 3, at least one of the main flaps 20 has a tab 32 projecting outwardly along the entire length of each side edge 28 of the main flap. Each tab shares a fold line f20 with a corresponding side edge of the main flap, which defines the boundary between the tab and the main flap. The tabs are bendable at the fold lines f20, enabling the tabs to bend at least 180° relative to the main flap. Specifically, the tabs can be positioned to project at a 90° degree angle toward the first face of the main flap, as shown in FIG. 5, or to project at a 90° angle toward the second face of the main flap, as shown in FIG. 6.

Figure 4:
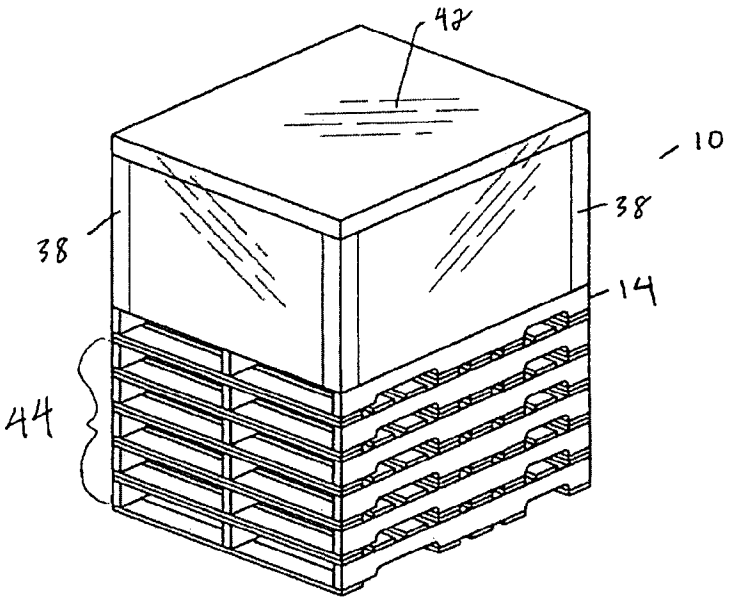
FIG. 4 is an isometric view of the packaging assembly depicted in FIG. 1, in the shipment configuration, placed atop a plurality of supporting pallets.

As shown in FIG. 1, the pallet 14 has a top surface 34, and upper surface edges 36. Each mounting flap 18 of the side panels 16 is affixed to the top surface of the pallet, such that the top edge 22 of the mounting flap is positioned toward the center of the pallet's top surface and the main flap 20 extends outwardly from the pallet. The mounting flap can be affixed to the pallet by typical securing means, such as nails, staples or glue. The fold line f10 is aligned along the upper surface edge of the pallet, enabling the main flap to be folded upwardly in an upper position, as shown in FIG. 4 or folded downwardly in a lower position, as shown in FIG. 7. FIGS. 5-6 illustrate the main flaps being folded downwardly from an upper position to a lower position. When the main flaps are all folded in an upper position, as shown in FIG. 4, the side panels define a storage cavity in which the plurality of product containers 12 reside. In a preferred embodiment, the storage cavity defined by the side panels is box-shaped.

FIG. 1 shows the pallet 14 with two side panels 16 affixed to the top surface 34 of the pallet, with two more side panels yet to be affixed. The side panels are affixed to the pallet such that each main flap 20 having tabs 32 is positioned adjacent a main flap without tabs. Thus, in a preferable embodiment, four side panels are affixed to the pallet with two main flaps having tabs positioned opposite each other and two main flaps not having tabs positioned opposite each other.

After the plurality of side panels 16 has been affixed to the pallet 14, the plurality of product containers 12 is contiguously arranged on the pallet to a desired height and width in preparation for shipping. The mounting flaps 20 are thus interposed between the pallet and the plurality of product containers.

As shown in FIGS. 5-6, the plurality of product containers 12 is contiguously arranged such that the area displaced by the plurality of product containers is substantially the same as the area in the enclosure created by the upwardly folded main flaps 20. The height of the contiguously arranged plurality of product containers is substantially the same, but not taller, than the length of the main flaps, as measured from the fold line f20 to the bottom edge 26 of the main flap. The width of the contiguously arranged plurality of product containers is substantially the same, but not wider, than the length of the main flaps, as measured from one end of the fold line f10 to the other end of the fold line f10.

Once the plurality of product containers 12 has been contiguously arranged on the pallet 14, each main flap 20 having a tab 32 is first folded upwardly to an upper position, with each tab folded perpendicularly toward the first face of the main flap. Then each main flap not having a tab is folded upwardly into an upper position, such that, as shown in FIG. 4, the main flaps not having tabs cover each tab on the main flaps having tabs. Each side edge 28 of the main flap aligns up with the side edge of the adjacent main flap, defining a box-like shape with four corners. The plurality of product containers is thus substantially enclosed by the main flaps, which provide structural support for the plurality of product containers during shipping. The tabs 32 advantageously provide a point of contact for the main flaps to be secured together. The tabs further ensure that no gaps occur between the side edges 28 of the main flaps during shipping, that would expose the plurality of product containers.

As shown in FIGS. 4-5, tape 38, or other suitable securing material, is affixed over each corner created where the side edges 28 of the main flaps 20 meet. The tape extends the entire height of the main flaps, as measured from the fold line f20 to the bottom edge 26 of the main flap. The tape secures the side edges 28 of the main flaps together to provide structural support for the packaging assembly 10 during shipping.

As shown in FIGS. 1 and 4-5, an upper lid 40 is provided, made of a fairly rigid sheet material, such as corrugated cardboard. The upper lid is placed over the plurality of product containers 12 and the upwardly folded main flaps 20. In this regard, the bottom edges 26 of the main flaps are received within the upper lid.

As shown in FIGS. 4-5, a suitable wrapping material 42 (shown by shaded lines), such as shrinkwrap material, is wrapped around the packaging assembly 10 during shipping in order to provide additional structural reinforcement to the packaging assembly. The wrapping material ensures that the side edges 28 of the main flaps 20 remain secured together and further ensures that the upper lid 40 does not become displaced.

As shown in FIGS. 1-2, once the packaging assembly 10 reaches its retail destination, the packaging assembly is placed upon a plurality of supporting pallets 44 stacked atop each other, with the number of supporting pallets required dependent on the length of the main flap 20, as measured from the fold line f20 to the bottom edge 26 of the main flap. Specifically, the height of the plurality of supporting pallets must be sufficient so that when the main flaps are folded downwardly and secured, as described further below, the main flaps do not reach further down than the ground. In a preferred embodiment, as shown in FIG. 7, the downwardly folded main flaps thus hide the pallet 14 and all the supporting pallets except for the bottom-most supporting pallet. The bottom-most supporting pallet is not hidden in order to allow the tines of a forklift to engage the bottom-most supporting pallet and move the packaging assembly to a desired location. It should be understood, however, that in other embodiments, the number of supporting pallets can be changed in order to hide the bottom-most supporting pallet from view.

As shown in FIG. 5, the shrinkwrap material 42 and upper lid 40 are removed and the tape 38 along the side edges 28 of the main flaps 20 to release the side edges from each other.

As shown in FIGS. 5-6, the main flaps 20 are then folded downwardly 180° from their upper position, with the main flaps having tabs 32 folded downwardly first. As shown in FIGS. 5-6, each tab is unfolded 180° from its position facing the first face of the main flap to project perpendicularly toward the second face of the main flap. The main flaps not having tabs are then folded downwardly 180° from the upper position, to cover each tab on the other main flaps. Each side edge 28 of the main flap aligns up with the side edge of the adjacent main flap 20.

The side edges 28 of the main flaps 20 are secured to each other by suitable securing means, such as tape, glue or staples. FIG. 7 shows the packaging assembly 10 in its final display configuration.

While a particular form of the invention has been illustrated and described, it will be apparent that various modifications can be made without departing from the spirit and scope of the invention. Thus, although the invention has been described in detail with reference only to the preferred embodiment, those having ordinary skill in the art will appreciate that various modifications can be made without departing from the invention. Accordingly, the invention is not intended to be limited, and is defined with reference to the following claims.

What is claimed is:

1. A packaging assembly for shipping and displaying a plurality of products, the packaging assembly comprising:
- a pallet having upper side edges;
- a plurality of product containers, each holding at least one product, contiguously arranged on the pallet; and
- a plurality of side panels, each including
  - a mounting flap, and
  - a main flap having side edges, a bottom edge and a first face and a second face,
  - wherein the mounting flap and the main flap share a fold line that allows the main flap to fold relative to the mounting flap,
  - wherein the mounting flap is interposed between the pallet and the plurality of product containers and is affixed to the pallet such that the fold line is located at one upper side edge of the pallet,
- wherein, during shipment of the packaging assembly, the main flaps are folded upwardly at their respective fold lines to substantially enclose the plurality of product containers;
- wherein, during display of the packaging assembly, the main flaps are folded downwardly at their respective fold lines to cover the pallet and to expose the plurality of product containers; and
- wherein the first face of the main flap is visible when the main flap is folded downwardly and not visible when the main flap is folded upwardly.

2. The packaging assembly of claim 1, wherein at least the first face of the main flap bears printed matter.

3. The packaging assembly of claim 1, wherein:
- each side edge of the main flap of at least one of the side panels includes a tab projecting outwardly at a fold line, and
- the tabs can be positioned toward either the first face of he main flap or the second face of the main flap at a 90° angle.

4. The packaging assembly of claim 3, wherein each tab extends substantially along the entire side edge of its corresponding main flap.

5. The packaging assembly of claim 1, wherein:
- the plurality of side panels comprise a first pair of opposing side panels and a second pair of opposing side panels;
- the main panels of at least the first pair of opposing side panels have tabs;
- the tabs are positioned at a 90° angle toward the first face of the main flaps when the first pair of opposing side panels is folded in an upper position; and
- the tabs are positioned at a 90° angle toward the second face of the main flaps when the first pair of opposing side panels is folded in a lower position.

6. The packaging assembly of claim 5, wherein the main panels of the second pair of opposing side panels overlap the tabs on the main panels of the first pair of opposing side panels.

7. The packaging assembly of claim 1, wherein each side edge of the main panels abuts the side edge of the adjacent main panel when folded into the upper position or the lower position.

8. The packaging assembly of claim 7, further comprising means for securing the side edges of the main flaps together.

9. The packaging assembly of claim 8, further comprising:

a removable lid that covers the plurality of product containers and receives at least the bottom edges of the main flaps within the lid during shipment of the packaging assembly; and a wrapping material to enclose the pallet, the plurality of product containers, the plurality of side panels and the lid.

10. The packaging assembly of claim 8, further comprising a plurality of supporting pallets placed underneath the packaging assembly during display of the packaging assembly.

11. The packaging assembly of claim 1, wherein the plurality of product containers is contiguously arranged such that the area displaced by the plurality of product containers is substantially the same as the area defined by the upwardly folded main flaps.

12. The packaging assembly of claim 10, wherein the height of the supporting pallets is sufficient to enable the main flaps of the side panels to fold downwardly without extending lower than the ground.

13. The packaging assembly of claim 1, wherein the mounting flap of each side panel is generally trapezoidal in shape.

14. The packaging assembly of claim 1, wherein the main flap of each side panel is generally rectangular in shape.

15. The packaging assembly of claim 1, wherein the side panels all are of unitary construction.

16. The packaging assembly of claim 1, wherein the side panels all are constructed of corrugated cardboard.

17. The packaging assembly of claim 1, further comprising a removable lid that covers the plurality of product containers and receives at least the bottom edges of the main flaps within the lid during shipment of the packaging assembly; and a wrapping material to enclose the pallet, the plurality of product containers, the plurality of side panels and the lid.

18. The packaging assembly of claim 1, further comprising a plurality of supporting pallets placed underneath the packaging assembly during display of the packaging assembly.

19. A packaging assembly for shipping and displaying a plurality of products, the packaging assembly comprising:

a pallet having upper side edges;

a plurality of product containers, each holding at least one product, contiguously arranged on the pallet;

a first pair of opposing side panels, each including a mounting flap, a main flap having a first face and a second face and side tabs; and a second pair of opposing side panels, each including a mounting flap, and a main flap having a first face and a second face, wherein each mounting flap and corresponding main flap share a fold line that allows the main flap to fold relative to the mounting flap, wherein each mounting flap is interposed between the pallet and the plurality of product containers and is affixed to the pallet such that the fold line is located at one upper side edge of the pallet, wherein, during shipment of the packaging assembly, the main flaps are folded upwardly at their respective fold lines to substantially enclose the plurality of product containers;

wherein, during display of the packaging assembly, the main flaps are folded downwardly at their respective fold lines to cover the pallet and to expose the plurality of product containers;

wherein, during shipment of the packaging assembly, the side tabs on the main flaps of the first pair of opposing side panels are foldable toward the first face of the main flap and the side tabs, during displaying of the packaging assembly, are foldable toward the second face of the main flap;

wherein the main panels of the second pair of opposing side panels overlap the side tabs on the main panels of the first pair of opposing side panels;

wherein the first face of the main flap is visible when the main flap is folded downwardly and not visible when the main flap is folded upwardly; and means for securing the main flaps to one another when they are in the upper position and in the lower position.

* * * * *